US011408176B2

(12) United States Patent
Low

(10) Patent No.: US 11,408,176 B2
(45) Date of Patent: Aug. 9, 2022

(54) MULTI-AXIALLY BRAIDED REINFORCEMENT SLEEVE FOR CONCRETE COLUMNS AND METHOD FOR CONSTRUCTING CONCRETE COLUMNS

(71) Applicant: Raymond Alan Low, Fresno, CA (US)

(72) Inventor: Raymond Alan Low, Fresno, CA (US)

( * ) Notice: Subject to any disclaimer, the term of this patent is extended or adjusted under 35 U.S.C. 154(b) by 0 days.

(21) Appl. No.: 16/996,905

(22) Filed: Aug. 19, 2020

(65) Prior Publication Data

US 2021/0054628 A1 Feb. 25, 2021

Related U.S. Application Data

(60) Provisional application No. 62/888,854, filed on Aug. 19, 2019.

(51) Int. Cl.

| | |
|---|---|
| ***E04C 5/06*** | (2006.01) |
| ***E04C 3/34*** | (2006.01) |
| ***E04G 13/02*** | (2006.01) |
| ***E04G 9/08*** | (2006.01) |
| ***E04C 5/07*** | (2006.01) |

(52) U.S. Cl.

CPC ..... *E04C 5/0609* (2013.01); *E04C 3/34* (2013.01); *E04C 5/07* (2013.01); *E04G 9/08* (2013.01); *E04G 13/021* (2013.01)

(58) Field of Classification Search

CPC .... E04C 5/0609; E04C 5/0613; E04C 5/0618; E04C 5/0622; E04C 5/0627; E04C 3/34; E04C 5/07; E04G 13/021; E04G 9/08

See application file for complete search history.

(56) References Cited

U.S. PATENT DOCUMENTS

| | | | | |
|---|---|---|---|---|
| 992,970 A | | 5/1911 | McClure | |
| 1,008,209 A | | 11/1911 | Skinner | |
| 1,356,570 A | | 10/1920 | Tupney | |
| 1,472,602 A | * | 10/1923 | Lally | E04C 3/30 52/301 |
| 1,670,543 A | | 2/1927 | Kellems | |

(Continued)

FOREIGN PATENT DOCUMENTS

JP 2004-244749 A 9/2004

OTHER PUBLICATIONS

FACE Report No. 13NY080, "Two Construction Workers Fatally Crushed When Cement Formwork Collapsed", New York State Department of Health FACE Program, Albany, New York, pp. 1-13.

*Primary Examiner* — Babajide A Demuren

(57) ABSTRACT

A multi-axially braided reinforcement sleeve that provides a low cost, simpler method to form strong concrete columns for constructing buildings and other structures. The braided reinforcement sleeve provides structural support and the rebar normally embedded to provide structural support in concrete can be eliminated, preventing the possibility of rebar oxidation which might otherwise undermine the structural integrity of the column. The reinforcement sleeve is lightweight, easy to transport, and can be greatly reduced in size to facilitate transportation. The reinforcement sleeve and construction method can be utilized in many implementations, and can be particularly useful for constructing buildings or other structures in geographic areas that are subject to earthquakes and where low cost is important.

14 Claims, 10 Drawing Sheets

(56) References Cited

U.S. PATENT DOCUMENTS

| | | | | | |
|---|---|---|---|---|---|
| 2,358,758 | A * | 9/1944 | Eames | E04C 5/07 | 138/144 |
| 2,788,700 | A | 4/1957 | Crossley | | |
| 3,110,982 | A | 11/1963 | Besinger | | |
| 3,725,167 | A | 4/1973 | Love | | |
| 3,892,161 | A | 7/1975 | Sokol | | |
| 4,092,897 | A | 6/1978 | Lalikos | | |
| 4,119,764 | A | 10/1978 | Mizuma | | |
| 4,304,169 | A | 12/1981 | Cimprich | | |
| 4,372,191 | A | 2/1983 | Iannucci | | |
| 4,567,917 | A | 2/1986 | Millard | | |
| 4,641,467 | A * | 2/1987 | Dupuis, Jr. | E04C 3/34 | 52/297 |
| 4,694,622 | A * | 9/1987 | Richard | B28B 7/34 | 52/223.5 |
| 4,716,807 | A | 1/1988 | Fischer | | |
| 4,719,838 | A | 1/1988 | DeYoung | | |
| 5,099,744 | A | 3/1992 | Hurst | | |
| 5,146,836 | A | 9/1992 | DeYoung | | |
| 5,218,810 | A | 6/1993 | Isley, Jr. | | |
| 5,220,859 | A | 6/1993 | DeYoung | | |
| 5,257,571 | A | 11/1993 | Richardson | | |
| 5,555,696 | A * | 9/1996 | Morrison, III | E04C 3/36 | 52/223.4 |
| 5,692,351 | A * | 12/1997 | Morrison, III | E04C 3/36 | 52/263 |
| 5,946,880 | A * | 9/1999 | Morrison, III | E04C 3/36 | 52/309.1 |
| 6,189,286 | B1 | 2/2001 | Seible | | |
| 6,219,988 | B1 | 4/2001 | Mahfouz | | |
| 6,219,991 | B1 | 4/2001 | Salck-Nejad | | |
| 6,295,782 | B1 * | 10/2001 | Fyfe | E04C 3/34 | 52/2.15 |
| 6,878,323 | B2 * | 4/2005 | Fyfe | E04C 3/34 | 156/184 |
| 7,311,031 | B2 | 12/2007 | McCullagh | | |
| 7,421,827 | B1 | 9/2008 | Konstantinidis | | |
| 8,261,648 | B1 | 9/2012 | Marchand | | |
| 2008/0184667 | A1 | 8/2008 | Hindi | | |
| 2015/0209916 | A1 | 10/2015 | Reinisch | | |
| 2017/0165077 | A1 | 6/2017 | McDonnell | | |
| 2017/0204544 | A1 | 7/2017 | Cooke | | |

* cited by examiner

Cement Paste Flows Out Through Gaps in Sleeve

Concrete Layer Formed Outside Sleeve

MULTI-AXIALLY BRAIDED REINFORCEMENT SLEEVE FOR CONCRETE COLUMNS AND METHOD FOR CONSTRUCTING CONCRETE COLUMNS

CROSS-REFERENCE TO RELATED APPLICATION

Reference is made, and priority is hereby claimed to U.S. Provisional Patent Application No. 62/888,854, filed Aug. 19, 2019, entitled MULTI-AXIALLY BRAIDED REINFORCEMENT SLEEVE FOR CONCRETE COLUMNS AND METHOD FOR CONSTRUCTING CONCRETE COLUMNS, which is incorporated herein by reference.

BACKGROUND

1. Field of the Invention

The invention relates to materials, components, and construction techniques for forming vertical support structures using concrete aggregate.

2. Description of Related Art

A fundamental and critical element of building construction is the vertical support structure that holds up the beams, roofs, and other parts of a building. One type of vertical support structure is a column, which is a strong, approximately cylindrical structure that can, for example, extend from floor to ceiling inside a structure, or outside, from the ground up to the first, second or subsequent floors. Each column is designed with the strength to hold the weight of what is above it, which can be very substantial. To construct vertical support structures, conventional construction techniques utilize concrete aggregate in combination with reinforcement materials such as rebar.

Concrete aggregate is commonly used in the construction industry. Concrete aggregate includes cement in various combinations with water, sand, gravel, and other materials that help add to its strength in the particular conditions in which the concrete will be employed. For ease of reference, the term "concrete" as used herein includes any of these combinations of cement and other materials that form a concrete aggregate.

Concrete has many advantages, including great compressive strength, good longevity with little maintenance, and it is relatively impervious to weather. However, there are some disadvantages to using concrete to construct columns. One disadvantage is concrete's low tensile strength. For example, if a column were to be made solely of concrete, it would crack and break relatively easily when subjected to tensile axial forces. To compensate for the low tensile strength, an internal structure is commonly utilized. For example, an internal structure may include one or more rebar rods situated vertically inside the column to improve the concrete column's tensile strength.

Under normal stress loads, rebar rods as internal structures function well with concrete and provide good support for concrete columns. However, unusual stresses from a catastrophic event such as an earthquake can cause shaking motions that can damage the concrete in the column, and eventually lead to structural failure. For example, an earthquake can pulverize the concrete in a column, and with nothing to contain it, the pulverized concrete pieces fall out, causing the entire column to fail, which in turn can bring down an entire building, or at least portions of it.

Another disadvantage of rebar-reinforced concrete columns is their construction cost, which can be substantial. To construct a concrete column, workers first install the rebar into a suitable foundation, then build formwork around the rebar that defines the column, and then build a frame that holds the column in place. Then the concrete is poured, and after it dries, the frame and formwork are removed and eventually discarded at the end of the project. Although sometimes formwork can be reused during the scope of a project, the ability to reuse it is limited. For example, if the formwork is unique, it can't be reused and will be discarded. Still another disadvantage is that rebar is heavy and can be expensive to transport, especially the pre-formed structures.

The conventional multi-step column construction technique described above using rebar, formwork, and frames, adds significant labor and material costs to the total construction cost of a building. Unfortunately it also creates a number of additional construction and practical problems such as: concrete honeycombing in the formwork; cold joints; bug holes; cracking concrete during form removal; over-vibration possibly causing formwork blowout; improper or insufficient ties being used; formwork failures; improper construction due to workers' lack of attention to formwork details; possible removal of formwork too early; the extensive time needed to plan for formwork and generating a realistic schedule and stripping time requirements; determining the capacity of equipment available to handle form sections and materials; determining the capacity of mixing and placing equipment; creating consistently strong construction joints; determining suitability for reuse of forms as affected by stripping time; considering the relative merits of job-built, shop-built and ready-made forms; and weather-related problems (such as rain or snow) that can adversely affect the formwork.

It would be an advantage to provide an improved system and method for constructing concrete columns that have a lower cost, better resistance to earthquake damage, and is easier and faster to construct.

SUMMARY

A multi-axially braided reinforcement sleeve for use in concrete columns and/or beams and a method for constructing concrete columns is described, which provides a low cost, simpler method to form strong concrete columns for constructing buildings and other structures.

The braided reinforcement sleeve can be manufactured inexpensively, and the construction method eliminates a number of steps from the conventional method, thus reducing the overall cost of constructing a concrete column. The rebar that normally is embedded axially in the column can be eliminated, along with the frame and formwork. Elimination of the rebar further reduces cost, and the braided reinforcement sleeve provides tensile axial support to the column as well as stronger resistance to earthquake damage and further eliminates the possibility of rebar oxidation which would otherwise undermine the structural integrity of the column.

The reinforcement sleeve is relatively lightweight (especially compared to rebar), easy to transport, and it can be reduced in size to facilitate transportation, in some embodiments even collapsed. The reduction in size allows the sleeve to be transported without special requirements, thereby reducing cost.

The reinforcement sleeve and construction method can be utilized in many implementations but can be particularly useful for constructing buildings or other structures in geographic areas that are subject to earthquakes and where low cost is important.

Construction using the reinforcement sleeve has several advantages. One advantage is the time and cost savings resulting from the elimination of formwork, installation, and removal. With no formwork, there is much less chance to damage the concrete column or to crack the concrete, which could otherwise happen when the formwork is removed. Another advantage of eliminating the formwork is that there are no bug holes to repair. Bug holes can be caused, e.g., by imperfections in the concrete and/or removal of the formwork. Furthermore, elimination of formwork would in turn eliminate the honeycombing in the concrete, which can be caused by air trapped between the formwork and the concrete.

Using a pre-manufactured reinforcement sleeve eliminates the construction problems related to unskilled labor such as improperly tying rebar, using insufficient ties, or failing to give appropriate attention to formwork details.

Another advantage is improved safety. Because the reinforcement sleeve is positioned before the concrete is poured, remains in place after the concrete is poured, and doesn't require formwork, the often fatal accidents related to formwork failures that can (and have) happened can be prevented. For example, eliminating formwork prevents accidents that might otherwise happen if formwork is removed too early (before the concrete is adequately cured and not structurally sound). It would also prevent accidents that could otherwise happen when the formwork itself fails for reasons such as poor design, reusing formwork that has lost its integrity even if it passes visual inspection, or just human error.

The reinforcement sleeve can be made in a number of different configurations, which can be designed and/or selected to meet the requirements of a large variety of construction jobs. To choose the appropriate configuration for a particular construction job, one consideration is the tensile strength of the sleeve. Generally, a sleeve is selected to have a weave pattern and be made of a material that can at least hold the hydrostatic pressure caused by the weight of the concrete poured into it. Thus, because the sleeve has already been designed to withstand the hydrostatic pressures of the liquid concrete, this eliminates blowouts and other problems that might be caused if old formwork were used, or if the formwork becomes over-vibrated which can cause separation of concrete mixtures, increased pressures, and subsequent blowouts in the formwork.

Construction using the reinforcement sleeve also eliminates the need to clean, inspect, transport, and store formwork, which would otherwise consume a tremendous amount of time and add cost during the construction project.

The reinforcement sleeve has a multi-axially braided configuration which provides a weaved pattern that defines a plurality of gaps. The gaps are intended to allow some cement paste to flow through to the outside while holding the coarse concrete aggregate inside the sleeve. Advantageously, the flow of cement paste (and may be some sand or smaller particles) through the gaps expels unwanted air and fills space within the sleeve, so that the sleeve column can become almost uniformly filled with concrete. A more uniform fill provides a stronger column structure substantially free of air pockets that might otherwise undermine the column's strength.

The multi-axially weaved structure is particularly useful because it defines a type of selective locking mechanism. The weave is close (tight) enough that it contains the coarse aggregate within the sleeve, yet defines gaps of a size that allows some of the sand and cement paste to flow through the gaps in the sleeve. This flow-through material can then be spread around the exterior of the sleeve, and after drying, becomes the cover for the column itself.

In one embodiment, during construction, the workers can attach the sleeve to a top structure and a bottom structure, and (optionally) insert a PVC pipe in the opening to help hold the sleeve in place. The PVC pipe also defines where the column is to be. Then add concrete, remove the optional PVC pipe, allow the cement paste to flow/seep through gaps in mesh, spread it smooth, and let it dry.

Another advantage is that rebar can be eliminated from the column in many embodiments. Not only does rebar add to cost, but it is believed that the properties of the rebar itself can contribute to the destruction of the column during an earthquake since the column is subject to alternating compression and tension as the earthquake waves pass through. The rebar rods, because they are made of metal, expand and contract differently from the concrete in which they are situated. The alternating compression and tension tend to eject and pulverize the concrete around the rebar, undermining the structure of the column and possibly leading to ultimate failure and subsequent collapse. Elimination of rebar prevents this problem, allowing the column to retain most of its strength during and after an earthquake.

BRIEF DESCRIPTION OF THE DRAWINGS

For a more complete understanding of this invention, reference is now made to the following detailed description of the embodiments as illustrated in the accompanying drawing, wherein:

FIG. 3A shows a circular cross-section, FIG. 3B shows a rectangular cross-section, FIG. 3C shows a flat rectangular ribbon cross-section, FIG. 3D shows a thin rectangular band cross-section, and FIG. 3E shows a strand formed from a plurality of smaller wires bound or woven together.

FIG. 8A shows the flow of cement paste out through the gaps in the sleeve, and FIG. 8B shows the concrete layer formed after the cement paste dries.

DETAILED DESCRIPTION

Terms

As used herein, the term "concrete", or "concrete aggregate" includes cement in various combinations with water, sand, gravel, rocks, and other materials that help to add to its strength in the particular conditions in which the concrete will be employed. For ease of reference, the term "concrete" as used herein includes any of these combinations of cement and other materials.

For purposes herein, concrete can be defined as including a cement paste, a coarse aggregate, and other materials such as sand. The term "coarse aggregate" includes larger solids, like rock and gravel. The term "cement paste" includes water mixed with cement. When fresh, cement paste typically flows in a semi-liquid manner.

Multi-Axial Braided Reinforcement Sleeve

Figure 1:
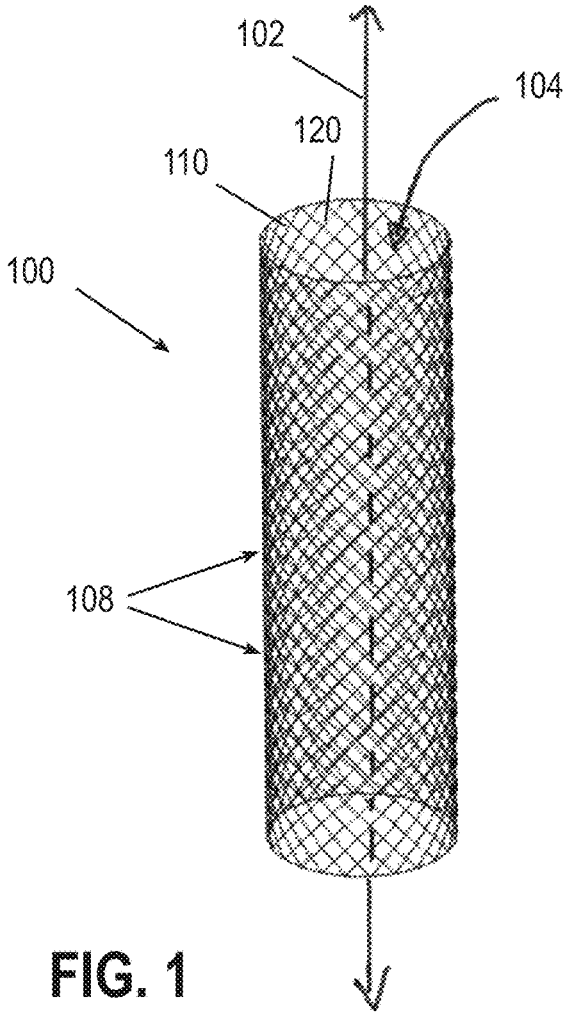
FIG. 1 is a perspective view of a multi-axially braided reinforcement sleeve in an extended configuration.
Figure 2:
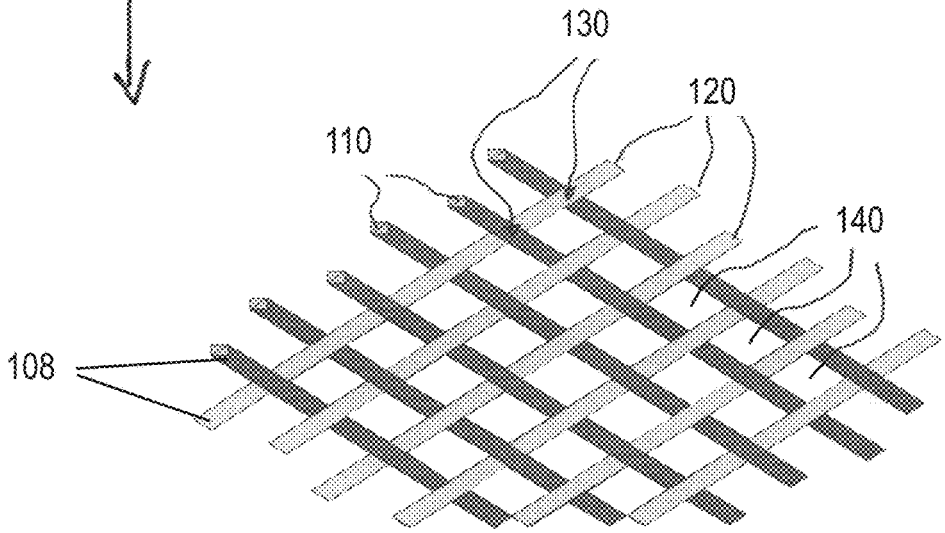
FIG. 2 is a perspective close-up view of a section of a biaxially braided reinforcement sleeve.

Reference is first made to FIGS. 1 and 2. FIG. 1 is a perspective view of a multi-axially braided reinforcement sleeve 100 in an extended configuration; FIG. 2 is a perspective closeup view of a cut-out portion of the biaxially braided reinforcement sleeve 100. As shown in FIGS. 1 and 2, the multi-axially braided sleeve 100 for use in constructing a concrete includes a plurality of strands 108 including at least a first plurality 110 of strands and a second plurality 120 of strands axially braided around a central axis 102 into a tubular braided structure that defines the sleeve 100 and a defines a central opening 104 axially through the tubular structure. Particularly, the first plurality of strands 110 are axially braided following a first rotation and the second plurality of strands 120 are axially braided following a second rotation counter-rotating to the first rotation. Thus, the first plurality of strands cross the second plurality of strands at a plurality of crossings 130, and the crossed pattern of the first and second plurality defines a plurality of gaps 140.

In many embodiments, such as the embodiment illustrated in FIG. 1 and FIG. 2, the braided reinforcement sleeve 100 has a biaxial weave pattern (the braid follows two counter-rotating axes) that define the plurality of gaps 140 between the strands 108, and the plurality of strand crossings 130 where the strands cross. In other embodiments, the weave pattern can be triaxial or more.

As will be described, the gaps are intended to allow some cement paste to flow through to the outside, while holding the coarse concrete aggregate inside the sleeve. Advantageously, the flow of cement paste (and may be some sand or smaller particles) through the gaps expels unwanted air and fills space within the sleeve, so that the sleeve column becomes approximately uniformly filled with concrete. A more uniform fill provides a stronger column structure substantially free of air pockets that might otherwise undermine the column's strength. The multi-axially weaved structure is particularly useful because it defines a type of selective locking mechanism. The weave is close (tight) enough that it contains the coarse aggregate within the sleeve, yet defines gaps of a size that allows some of the sand and cement paste to flow through the gaps in the sleeve. This flow-through material then can be spread around the exterior of the sleeve, and after drying becomes the cover for the column itself.

The material used in the strands 108 can be any flexible material such as metal, kevlar, plastic, nylon, ceramics, aramid, carbon or glass fiber, or natural or synthetic material of suitable strength and durability that has the appropriate characteristics for the desired end application. And the material must be flexible enough for weaving into a weaved configuration.

Figure 3A:
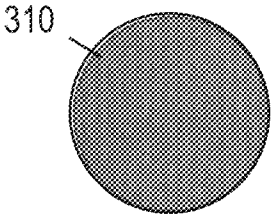
FIGS. 3A, 3B, 3C, 3D, and 3E are cross-sectional views of several different strand configurations.
Figure 3B:
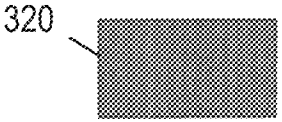
Figure 3C:
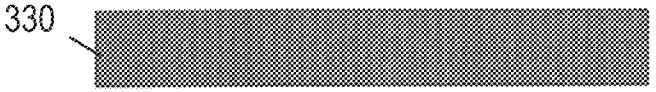
Figure 3D:
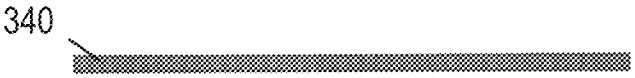
Figure 3E:
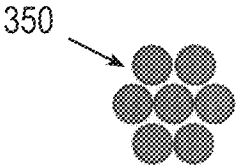

FIGS. 3A, 3B, 3C, 3D, and 3E are example configurations for each single strand 108, illustrating that the strands can have different forms and configurations. The strands can have any suitable configuration: FIG. 3A shows a circular cross-section 310 like a wire, FIG. 3B shows a rectangular cross-section 320, FIG. 3C shows a flat rectangular ribbon cross-section 330, FIG. 3D shows a thin rectangular band cross-section 340, and FIG. 3E shows a strand formed from a plurality of smaller wires bound or woven together. To choose the appropriate configuration for a particular construction job, one consideration is the strength of the sleeve. Generally, a sleeve is selected to have a weave pattern, a strand configuration, and be made of a material that can at least hold the hydrostatic pressure caused by the weight of the concrete poured into it. Thus, because the sleeve has already been designed to withstand the hydrostatic pressures of the liquid concrete, this eliminates blowouts and other problems that might be caused if old formwork were to be used, or if the formwork was over-vibrated which can otherwise cause separation of concrete mixtures, increased pressures, and subsequent blowouts in the formwork.

Although typically the material and strand configuration will be consistent throughout the sleeve, in some embodiments some strands may comprise different materials and/or different configurations. For example, in the same sleeve, some strands may be nylon and others may be kevlar; some strands may have a wire configuration and others may have a band configuration. The materials and configuration of the strands are chosen based upon their properties to create the desired strength, flexibility, and weave pattern of the end product sleeve.

Examples of strands used in the reinforcement sleeve include the following:

1) ⅛ inch circular wire;
2) Bands that are as much as 2 to 3 inches across yet thin enough to be weaved or braided;
3) The bands could be made of metal strips or synthetic materials braided into ribbons that are weaved into the cylindrical sleeves;
4) A ribbon that is a blend of different materials;
5) The strands are plastic, with a rectangular cross-section that is about ½ inch wide and 1/32 inch thick;
6) Each strand could comprise 5 to 10 tie wires that are weaved into the sleeve;
7) The strands could be metal bands ½ an inch to 3 inches wide that are weaved into a sleeve, similar to the metal bands that hold lumber together for transport;
8) The strands could be plastic bands of various sizes weaved into sleeves, similar to the plastic bands used to hold boxes together when mailed; and
9) The material of the strands could be kevlar, nylon, aramid, glass or carbon fiber, or any synthetic or natural material of suitable strength and durability braided into ribbons similar to shoelaces, but wider, that can be weaved into sleeves.

As shown in FIG. 2, the multi-axial braiding 100 of the strands 108 provides a weaved pattern that defines the plurality of crossings 130 and the plurality of gaps 140. The gaps 140 are intended to allow some cement paste to flow through to the outside, while holding the coarse concrete aggregate inside the sleeve. More particularly, the gaps 140 define openings that have a size small enough to substantially contain concrete coarse aggregate like gravel and rocks, and large enough to allow a minimal flow of cement paste from the inside of the sleeve to the outside.

The weave pattern, and desired size of the gaps 140 to allow flow-through, depend upon several factors such as design requirements, the properties of the concrete mixture, and the outside temperature. Different types of concrete may require a different weave pattern, i.e. a particular sizing of gaps, angle of weave, and type of reinforcement bands/ribbons. The type of concrete can change the needed gap size, for example, a different gap size would be needed if the coarse aggregate size is about ½ inch versus 2 inches. Also, the compression stress of concrete can vary anywhere from 3,000 psi to 10,000 psi, the water/cement ratio can vary depending on weather conditions, the size of pour, and the type of cement that is used. All these are factors can be considered when selecting the appropriate sleeve for a particular installation.

During an earthquake or other tensile stresses, the weaved structure of the multi-axial braid reinforcement sleeve tightens around the column, holding in the concrete and reducing damage to the interior concrete, which can prevent failure of the concrete column. Generally, this tightening is the behavior of a cylindrical, helically wound braid; pulling the braid lengthens and narrows it. The length is gained by reducing the angle between the warp and weft threads at their crossing points, but this reduces the radial distance between opposing sides and hence the overall circumference.

Fabricating the Multi-Axially Braided Sleeve

Fabricating the multi-axially braided sleeve can be accomplished using any suitable method. Many braiding methods are known in the art, and the particular method chosen for forming the braided tubular structure will depend upon the requirements of any particular implementation. A few examples of methods and apparatus that can braid strands to create a tubular configuration are shown in US Patent Publication US20150299916, U.S. Pat. Nos. 7,311,031, 5,257,571, and 5,099,744.

As described above, the configuration of the strands 108, given the material, must be thin enough to be flexible, but thick enough to substantially contain the concrete in the weaved pattern, while allowing some cement paste to flow through the gaps defined in the weaved pattern.

In a preferred embodiment, the braid has a biaxial weave pattern in which the first set of strands are wrapped around the central axis in a first rotation, and the second set of strands are wrapped around the central axis in a second, opposite rotation. In other embodiments, the sleeve may have a triaxial weave pattern, or another suitable weave pattern.

There is great flexibility in the materials and configuration of the braided structure. Typically, the braided structure will be formed with a uniform braid pattern throughout its length. Still, many variations are possible with a uniform braid pattern, for example, the weaved pattern could include a finer mesh that would hold in place a stronger but looser weave of a different material. For example, the weaved pattern could include a finer nylon mesh that holds heavier kevlar belts that are weaved into sleeves.

In some embodiments, it may be useful to vary the braid pattern in certain areas, so that the braid is nonuniform along its length. For example, one embodiment may create additional strength in certain portions of the sleeve by a tighter weave, or in other embodiments, more flexibility in the braid can be provided by using a looser weave.

Method of Column Construction

To recap the conventional construction method discussed above in the prior art section, in conventional concrete column methods, workers first install vertically-extending rebar rods into a suitable foundation, then build formwork around the rebar to define the column, and then build a frame that holds it all in place. Then the concrete is poured in, and after it dries, the frame and formwork are removed. This conventional multi-step construction technique has several disadvantages, such as adding significant labor and material costs to the total construction cost of a building, creating safety issues, and lengthening the construction time. Furthermore, in the event of an earthquake, the columns may fail, and the rebar itself can contribute to failure of the column.

The method described herein simplifies construction by eliminating conventional formwork and replacing it with a pre-manufactured sleeve. The ceiling holds the sleeve in place on its upper end, and the floor provides a foundation at a lower end. Conventional axial rebar and ties are optional and may be eliminated; for some uses rebar may even be undesirable. Particularly for earthquake-prone locations, the no-rebar embodiment is preferred.

Figure 4:
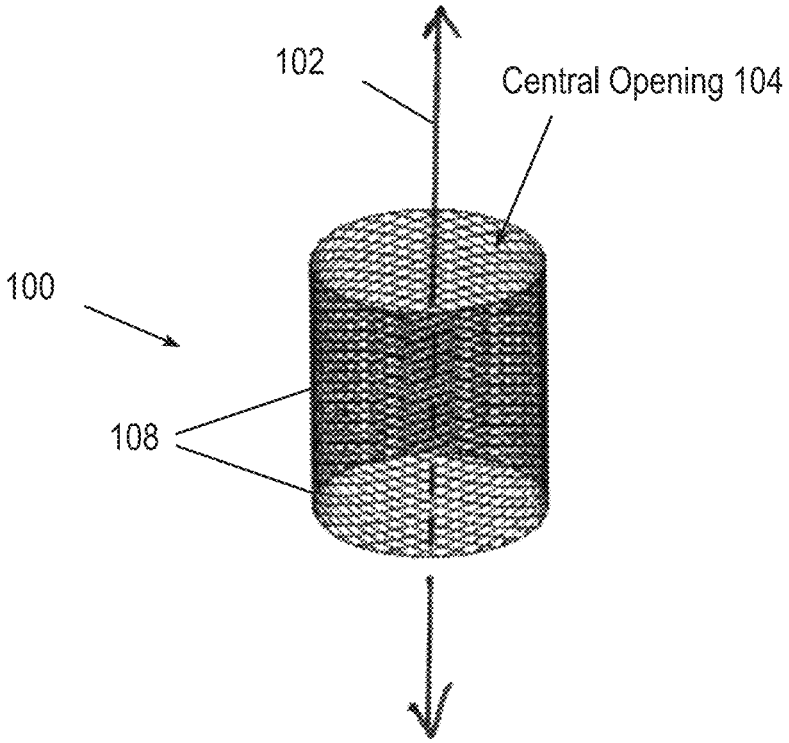
FIG. 4 is a perspective view of the reinforcement sleeve compressed (packed down) to a reduced size that may be used for transportation.

FIG. 4 is a perspective view of the reinforcement sleeve 100 compressed (packed down) to a reduced size for transportation. In FIG. 4 the sleeve is shown compressed along its axis 102, but more generally the sleeve can be packed down in any manner suitable to the materials and configuration of the strands 108. For example, if the sleeve is made entirely of plastic bands, it may be folded laterally, compressed axially, or even wound in a roll.

Figure 5:
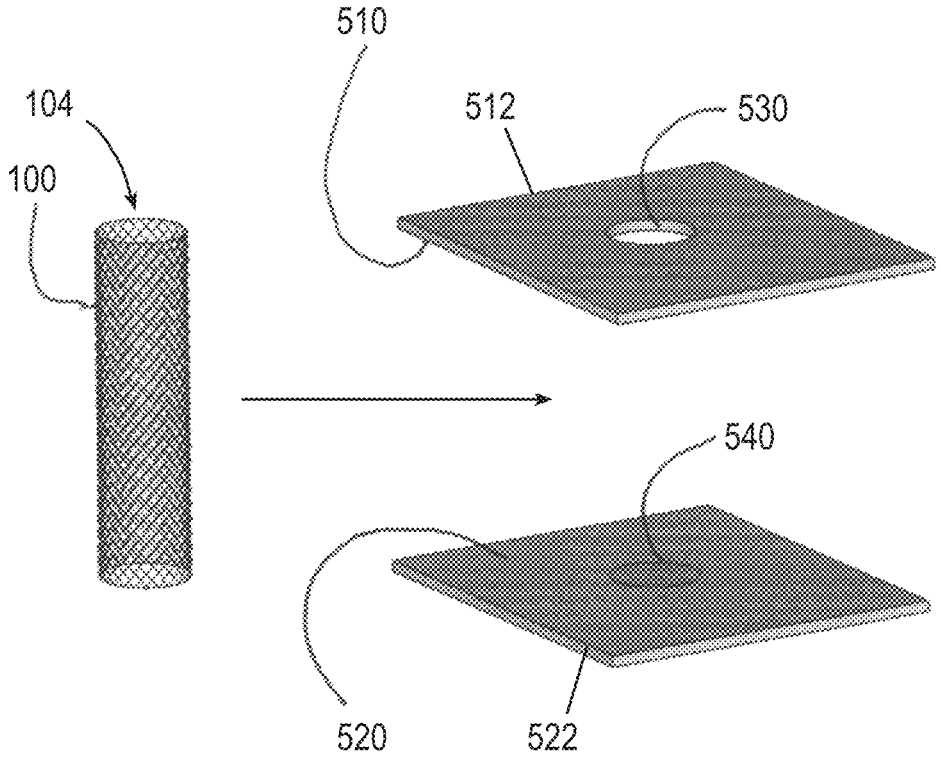
FIG. 5 is a perspective view of an installation location including an upper and lower surface defined on upper and lower structures, and a sleeve.

FIG. 5 is a perspective view of a location prepared for installing a concrete column with the reinforcement sleeve 100. The installation location includes an upper surface 510 shown on a section of an upper structure 512 (e.g. a ceiling) and a lower surface 520 shown on a section of a lower structure 522 (e.g. a floor) to which the sleeve 100 is affixed.

One way to install a column is to pour the columns remotely (as modules) and then move the poured columns to the installation location. Another way is to attach the respective ends of the sleeve 100 to the upper surface 510 and lower surface 520 using any suitable attachment method, such as tying the reinforcement sleeve 100 into the existing rebar found in the floor and ceiling concrete slabs.

In some embodiments, the joint at the end of the column may be a straight cylinder (see. FIG. 11) whereas other embodiments (see FIGS. 6, 7, and 10) may include a joint support such as a concave flaring cone of increasing diameter, or a vase-like structure that expands out from near the end of the column to the adjacent surface or foundation. The expanding joint support would also increase strength and ductility in the column beam and column slab connections.

If joint support tying into the existing rebar in the floor and ceiling concrete slabs is not used, the concrete columns could be poured at another location, transported, and lifted into place and attached with grouted dowels.

In the embodiment of FIG. 5, an opening 530 in the upper surface 510 is provided to allow the concrete to be poured into the central top opening as is done with conventional formwork. Generally, the central opening 104 of the sleeve 100 must be accessible in some manner, so that concrete can be poured in. If there are circumstances where the opening at the top of the column is not available, spreaders could be used to create an opening in the side of the reinforcement sleeve through which concrete can be poured, and then the spreaders can be removed and the sleeve reassembled or mended.

Figure 6:
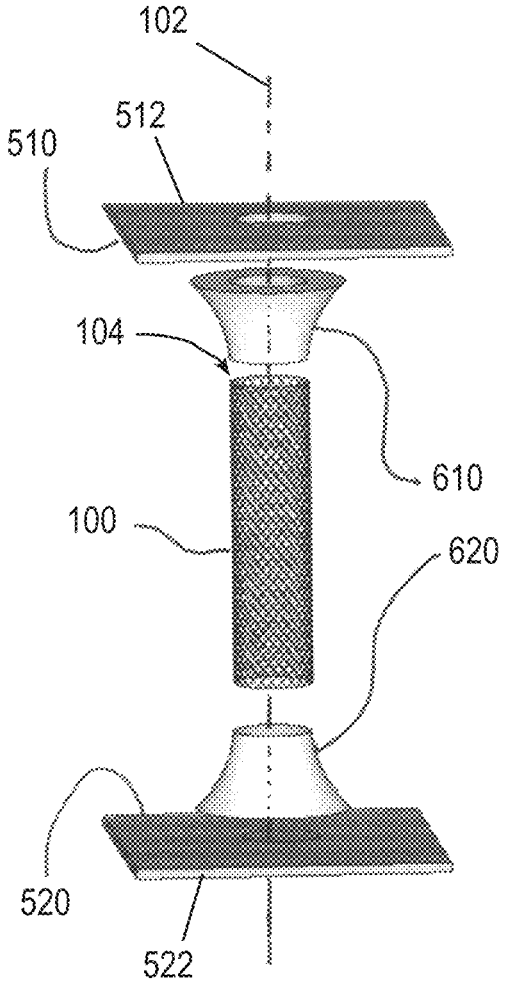
FIG. 6 is an expanded perspective view illustrating how the reinforcement sleeve is aligned and attached to the upper and lower surfaces in one embodiment.

FIG. 6 is an expanded perspective view of the reinforcement sleeve 100 positioned between the upper surface 510 and lower surface 520, and including an upper joint support 610 and a lower joint support 620 in the form of a concave flaring cone shape at the respective connections with the upper surface 510 and the lower surface 520.

In some methods, a pipe such a PVC pipe (not shown) can be inserted into the central opening 104. The outer diameter of the PVC pipe fits within the central opening 104 and preferably is adjacent to the inner diameter of the installed reinforcement sleeve 100. Thus the PVC pipe would be nested inside the reinforcement sleeve 100, and the cylindrical structure of the PVC pipe holds the reinforcement sleeve in place while the concrete is being poured.

Figure 7:
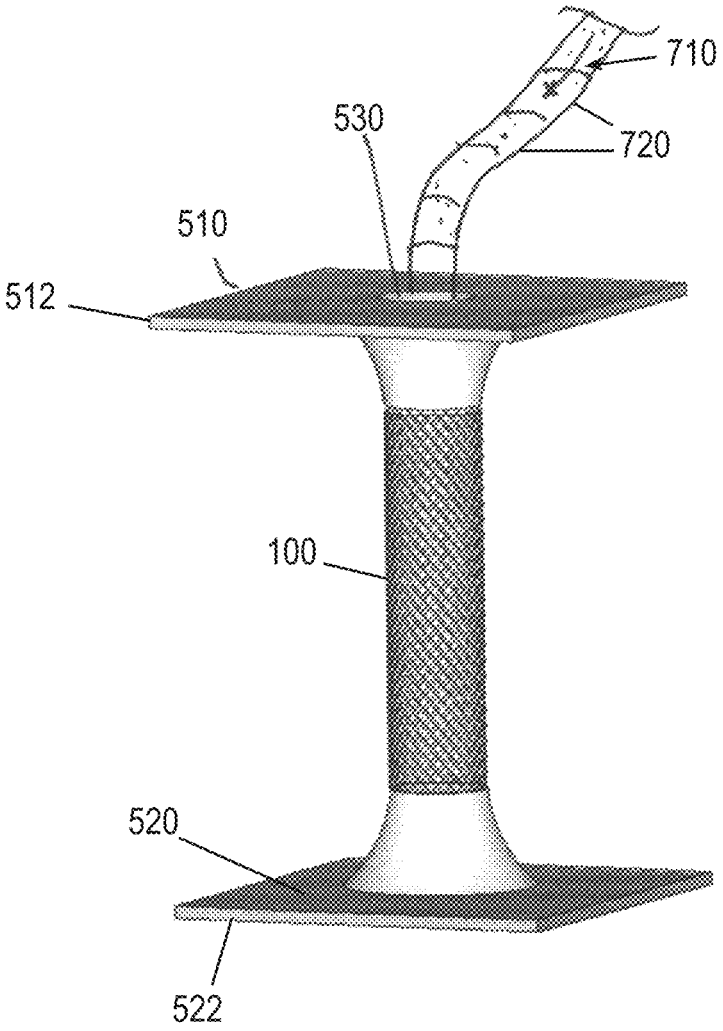
FIG. 7 is a perspective view of concrete being poured through a tube into the central opening of the sleeve.

FIG. 7 is a perspective view of concrete 710 being poured via a delivery tube 720 and through the opening 530 in the upper surface 510 into the central opening 104 of the sleeve 100. Generally, the concrete is poured into the central opening 104 until it is filled.

In the embodiment of FIGS. 5, 6, and 7, an opening 530 in the upper surface 510 is provided to allow the concrete 710 to be poured through and into the central opening 100 as is done with conventional formwork. Generally, the central opening 104 of the sleeve 100 must be accessible in some manner, so that the concrete 710 can be poured in. If in an alternative embodiment there are circumstances where the opening 530 at the top of the column is not available, spreaders could be used to create an opening in the side of the reinforcement sleeve 100 through which concrete can be poured and the spreaders removed and the sleeve 100 reassembled or mended.

In the embodiment where the PVC pipe is utilized to maintain the columnar structure while the concrete is being poured, the PVC pipe within the opening is first filled with concrete. Then, the PVC pipe is removed, more concrete is added to fill the space vacated by the PVC pipe, and to fill the opening, and the concrete is allowed to flow to the reinforcement sleeve.

Figure 8A:
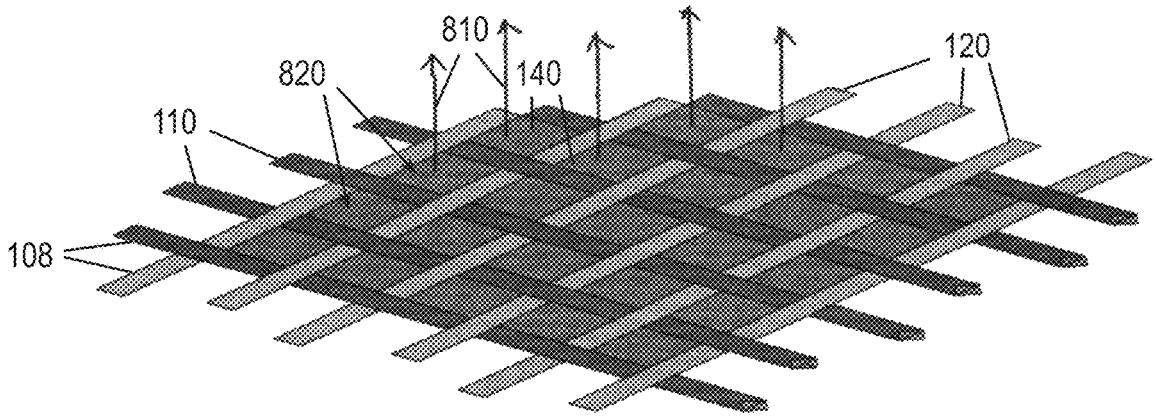
FIGS. 8A and 8B are close-up perspective views of a section of the outside of the column during and after construction.
Figure 8B:
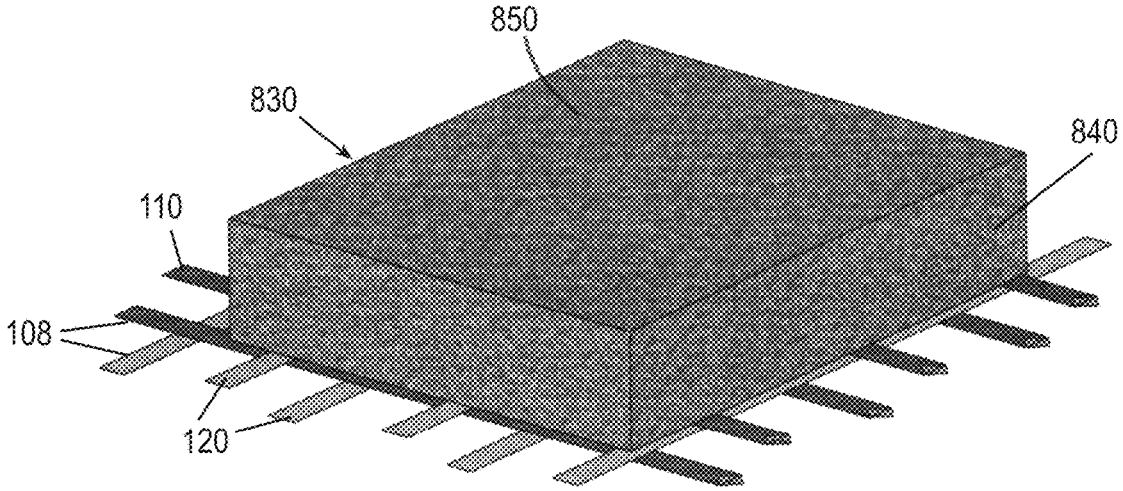

FIGS. 8A and 8B are close-up perspective cut-out views of a section of the outside of the column after concrete has been poured in. FIG. 8A illustrates the flow 810 of cement paste 820 out through the gaps 140 between the strands 108 in the sleeve 100, and FIG. 8B shows a section 830 of the resulting concrete layer 840 formed after the cement paste 820 has flowed through and dries. As discussed above, the reinforcement sleeve 100 defines gaps 140 that are large enough to allow a small flow of the semi-liquid cement paste and small particles such as sand, but small enough to prevent the outward flow of coarse aggregate (e.g. gravel, rocks). As the semi-liquid cement paste 820 flows through the gaps 140, reaches the outer surface of the reinforcement sleeve, and dries enough to be spread, it can then be spread by workers into a smooth outer surface 850.

Figure 9:
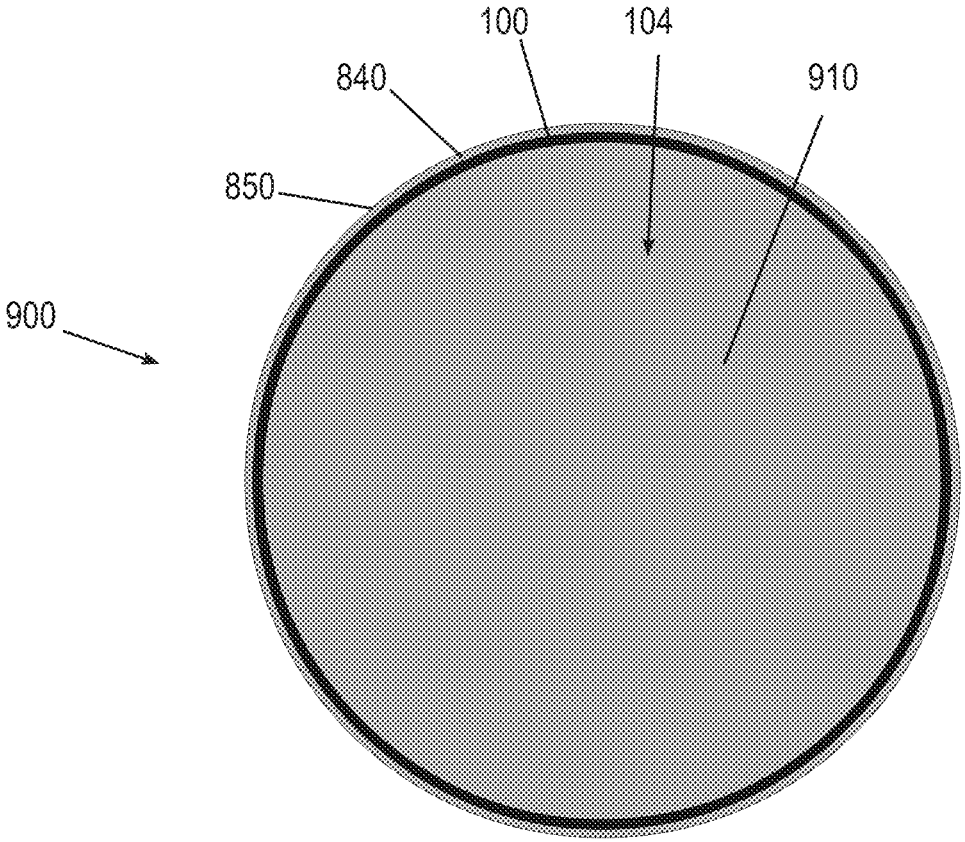
FIG. 9 is a cross-sectional view of a completed column including the multi-axial reinforcement sleeve with concrete inside and a concrete layer outside.

FIG. 9 is a cross-sectional view of a completed column 900 such as column 1000 (FIG. 10) or column 1100 (FIG. 11), illustrating the outer smoothed surface 850 of the column. Adjacent to the surface 850, the outer layer 840 of dried cement paste and small particles enclose the reinforcement sleeve 100. The central opening 104 is now filled with concrete, including coarse aggregate and cement paste, that provides a concrete core 910, as shown in FIG. 9. The reinforcement sleeve 100 is now embedded in concrete on the outside perimeter of the concrete core 910.

As shown in FIG. 9, the reinforcement sleeve 100 contains the concrete within the core 910 and supports the column 900 transversely. Yet during extreme earthquake events, the sleeve 100 doesn't go under compression and therefore does not expand to cause any damage to the column. Instead, if the column drifts due to earthquake forces, the reinforcement sleeve will elongate and tighten around the column whenever the column needs lateral support.

Figure 10:
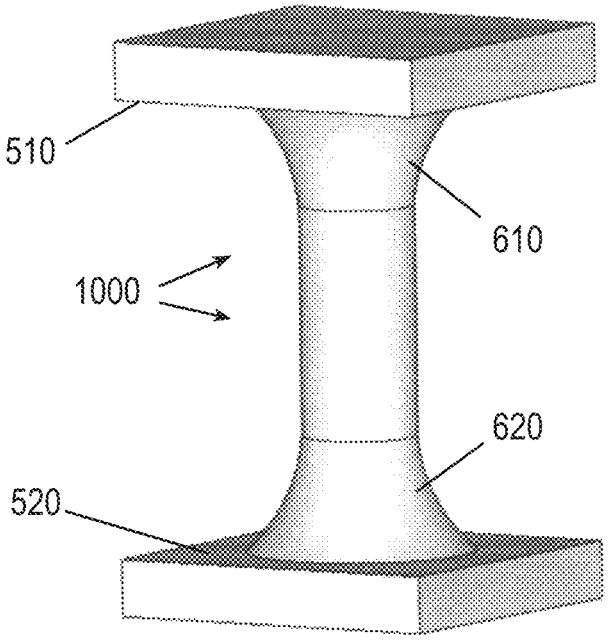
FIG. 10 is a perspective view of the finished column after the outside surface has been smoothed.
Figure 11:
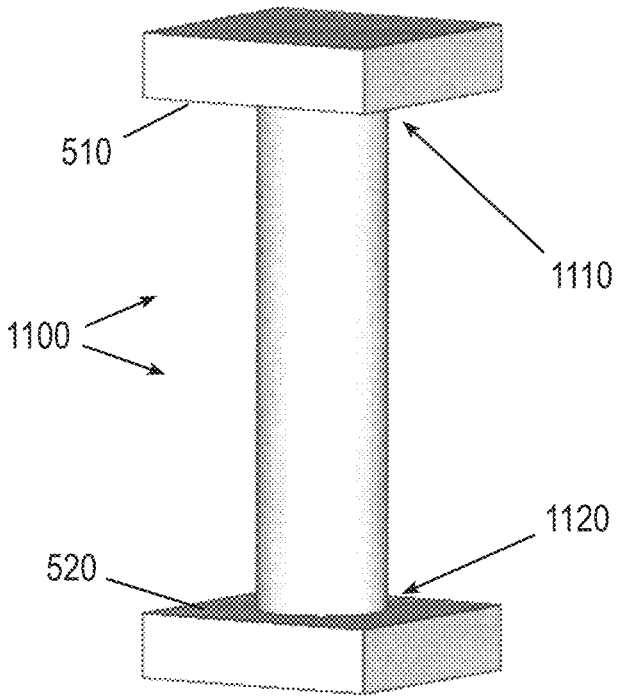
FIG. 11 is a perspective view of a finished column in an alternative implementation in which a straight cylindrical joint support is utilized.

FIG. 10 is a perspective view of one embodiment of a finished column 1000 after the outside surface has been smoothed including the concave. In this embodiment, upper joint support 610 and the lower joint support 620 have the form of a concave flaring cone shape at their respective connections with the upper surface 510 and the lower surface 520.

FIG. 11 is a perspective view of another embodiment of a finished column 1100 in which a straight cylindrical joint support configuration is used for the upper joint 1110 and a lower joint 1120, instead of the concave flared cone configuration shown in the embodiment of FIG. 10.

Although an implementation described herein utilizes the reinforcement sleeve 100 to form a column such as column 1000 or column 1100, it can also be used to create other support structures such as a beam.

As an alternative construction technique, rather than forming the concrete column in place, the column could be formed elsewhere and then transported to the installation. For example, the column could be formed on the job site or in a nearby location, and then lifted into position to be installed.

In many embodiments, the step of installing rebar axially along the length of the column may be eliminated entirely to save cost and also to prevent destruction during an earthquake. However for some purposes, a small amount of rebar may still be useful; for example a small length of rebar, may be a few inches, can be installed extending into the either or both ends of the column to prevent the ends of the columns from sliding.

Theory of Earthquake Effects on Rebar-Reinforced Columns

It is believed that rebar itself, which normally strengthens a column, can become a significant destructive factor during an earthquake. Particularly, an earthquake's energy travels in waves, which alternately compresses and decompresses whatever is in its path. When the earthquake's waves interact with conventional rebar-reinforced columns, it is believed that the compressive loads travel along the rebar and cause the rebar to expand significantly at its weakest point. The rebar expands much more than the concrete, an effect that can exacerbate or even cause the demise of concrete columns under earthquake conditions, for the following reason.

Poisson's Ratio is a measure of the Poisson Effect, a phenomenon in which a material expands in a direction perpendicular to the direction of compression. If the material is stretched rather than compressed, it contracts in a direction transverse to the direction of stretching. Poisson's Ratio for steel is about 0.27-0.30, whereas the Poisson's Ratio for concrete is about 0.1-0.2.

Potentially this means that the steel rebar could expand as much as three times that of the concrete under the same compressive deformation. So, under the compressive deformation caused by earthquakes, the expanding rebar can cause spalling of the surrounding concrete (breaking the surrounding concrete into smaller pieces). As earthquake shaking continues, the concrete can be ejected from the column. The loss of concrete ejected from the column weakens the column structurally, and if it continues eventually can leave only rebar, which is inadequate to support the entire column, possibly leading to structural failure and eventual collapse of an entire building. Elimination of rebar prevents this problem, and the multi-axial braided reinforced sleeve holds the concrete in the column, prevents spalling, and allows the concrete column to retain its strength during and after an earthquake.

What is claimed is:

1. A structurally reinforced concrete column, comprising:

a substantially solid concrete core consisting essentially of concrete formed of a dried cement paste mixed with a coarse aggregate;

a flexible, multi-axially braided reinforcement sleeve embedded in the concrete on the perimeter of the core to reinforce the column, the flexible multi-axially braided sleeve including a first plurality of strands and a second plurality of strands axially braided into a braided structure, the first plurality of strands axially braided following a first rotation and the second plurality of strands axially braided following a second rotation chosen so that the first plurality crosses the second plurality of strands and provides a weaved pattern that provides a flexible sleeve and defines a plurality of gaps, each of the plurality of gaps defining an opening having a size small enough to substantially contain concrete coarse aggregate and large enough to allow a minimal flow of the cement paste.

2. The structurally reinforced concrete column of claim 1 wherein the strands in the first and second plurality of strands have a cross-section that is approximately circular.

3. The structurally reinforced concrete column of claim 1 wherein the strands in the first and second plurality of strands comprise bands that have an approximately rectangular cross-section.

4. The structurally reinforced concrete column of claim 1 wherein the strands in the first and second plurality of strands comprise a flexible material.

5. The structurally reinforced concrete column of claim 4 wherein the flexible material comprises at least one of steel, metal, plastic, nylon, kevlar, aramid, ceramics, glass, and carbon fiber.

6. The structurally reinforced concrete column of claim 4 wherein the weaved pattern of first and second strands has a biaxial configuration.

7. The structurally reinforced concrete column of claim 6 wherein the braided structure has a tubular configuration.

8. The sleeve of claim 1 wherein the strands include a ribbon configuration that is a blend of different materials, including at least one of steel, metal, plastic, nylon, kevlar, aramid, ceramics, glass and carbon fiber.

9. The concrete column of claim 1, wherein the concrete core does not include rebar for axial support along its length.

10. The concrete column of claim 1, wherein the weaved pattern is configured so that in response to an earthquake and other tensile stresses, the flexible multi-axial braid reinforcement sleeve tightens around the column.

11. The structural concrete column of claim 1, further comprising a concrete outer layer formed with semi-liquid cement paste that has flowed through the gaps in the multi-axially braided sleeve.

12. The structural concrete column of claim 11 wherein the concrete outer layer extends outside of the sleeve to fully enclose the sleeve.

13. The concrete column of claim 12, wherein the concrete outer layer has a substantially smooth outer surface.

14. The concrete column of claim 4 wherein the flexible material comprises at least one of kevlar, aramid, ceramic, glass, and carbon fibers.

* * * * *